US007497700B2

(12) United States Patent
Chen et al.

(10) Patent No.: US 7,497,700 B2
(45) Date of Patent: Mar. 3, 2009

(54) ELECTRICAL CONNECTOR

(75) Inventors: De-Jin Chen, ShenZhen (CN); Wei Yuan, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/901,948

(22) Filed: Sep. 19, 2007

(65) Prior Publication Data

US 2008/0076277 A1 Mar. 27, 2008

(30) Foreign Application Priority Data

Sep. 22, 2006 (TW) ..... 95217012 U

(51) Int. Cl.
*H01R 12/00* (2006.01)

(52) U.S. Cl. ..... 439/78

(58) Field of Classification Search ..... 439/78, 439/260, 498, 74, 569, 135, 626, 751, 851
See application file for complete search history.

(56) References Cited

U.S. PATENT DOCUMENTS 4,993,975 A * 2/1991 Asick et al. ..... 439/751
5,383,797 A * 1/1995 Seong et al. ..... 439/569
5,919,051 A * 7/1999 Mitra ..... 439/74
6,146,172 A * 11/2000 Wu et al. ..... 439/260

* cited by examiner

*Primary Examiner*—Edwin A. Leon
(74) *Attorney, Agent, or Firm*—Wei Te Chung

(57) ABSTRACT

An electrical connector includes a connector body (2), and a plurality of passageways (20). A passageway retention wall (202) extends into each of the passageways. Each of the terminals (3) has a terminal retention section (322) defining thereof a retention edge, which is adapted to be rested on said passageway retention wall for securing the terminal onto the connector body. This arrangement will prevent the connector body to be removed therefrom by an improperly upward force, such as force applied to pull out the mating component from the electrical connector.

16 Claims, 7 Drawing Sheets

ELECTRICAL CONNECTOR

BACKGROUND OF THE INVENTION

1. Field of the Invention

The present invention relates to the art of electrical connectors.

2. Description of the Related Art

A conventional electrical connector typically includes a connector body having a mating surface, which is adapted to mate with a mating component, a mounting surface, which is adapted to face a printed circuit board, and a plurality of passageways extending from the mating surface towards the mounting surface through the connector body. Terminals may be insertable into the respective passageways in a direction from the mounting surface towards the mating surface, or in an opposite direction from the mating surface towards the mounting surface. Each of the terminals includes a retention section adapted to engage the passageway of the connector body with an interference fit, and a tailing section to be mounted onto a printed circuit board. A problem, however, with the electrical connector is that it is easy for the user to remove the connector body from the printed circuit board by an upward force, which is applied to pull out the mating component from the mated electrical connector. This is so because the terminals are not securely held within the connector body merely by such an interference fit between the terminals and the passageways of the connector body. Therefore, there is a need to provide a new connector to resolve the above-mentioned problem.

SUMMARY OF THE INVENTION

A major object of an embodiment of the present invention is to provide an electrical connector for maintaining a secure connection between terminals and a connector body for preventing the connector body to be removed from a printed circuit board, onto which the electrical connector is mounted.

An electrical connector according to an embodiment of the present invention includes a connector body having a mating surface and a mounting surface, and a plurality of passageways extending from the mating surface towards the mounting surface and through said connector body. A passageway retention wall extends into each of the passageways. Terminals are inserted into the passageways from the mating surface. Each of the terminals has a terminal retention section defining thereof a retention edge, which is adapted to be rested on the passageway retention wall for securing the terminal onto the connector body. This arrangement will prevent the connector body to be removed therefrom by an improperly upward force exerted thereon, such as force applied to pull out the mating component from the electrical connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
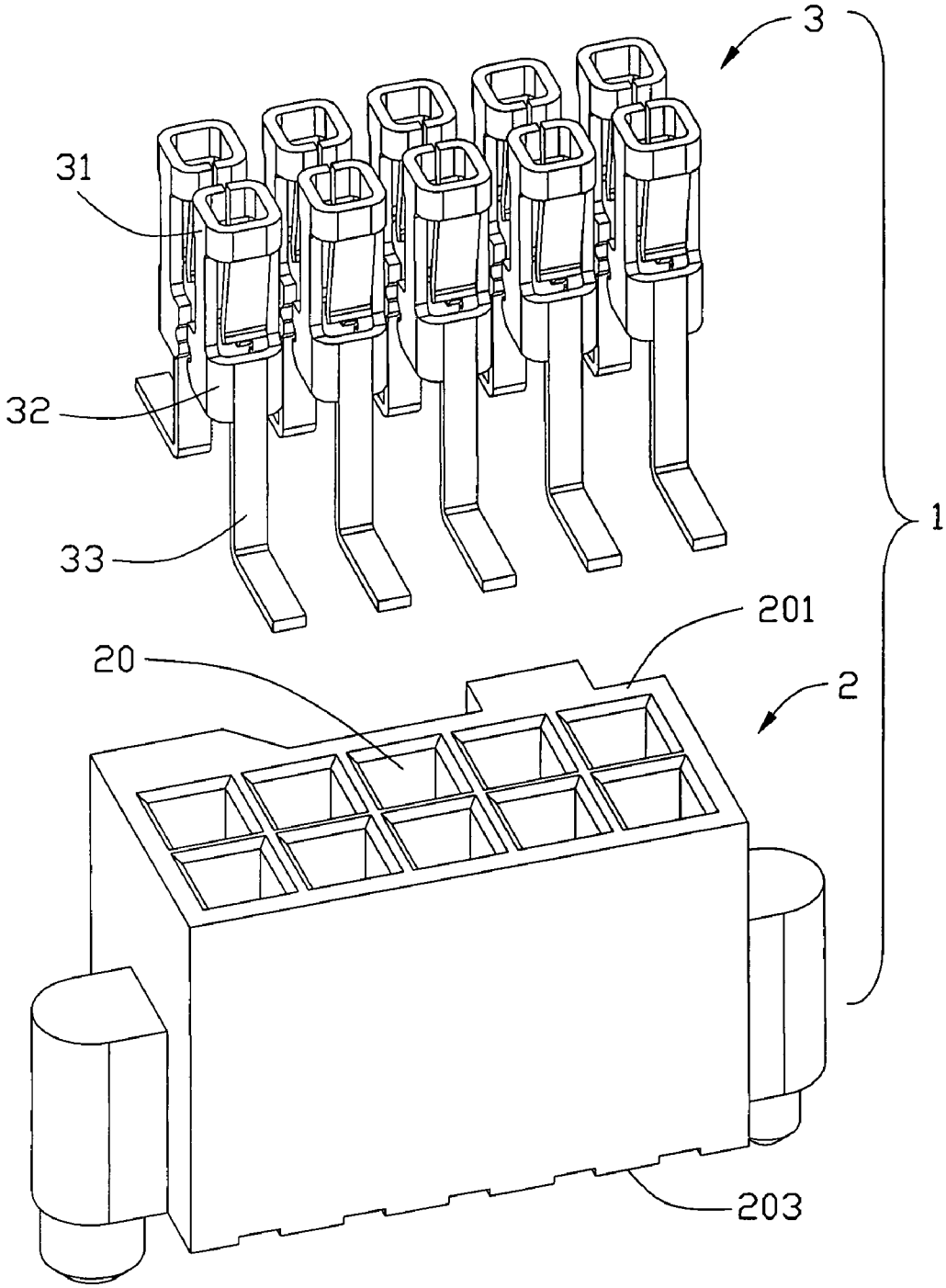
FIG. 1 is an exploded, perspective view of an electrical connector according to an embodiment of the present invention.

Referring to FIGS. 1 to 7, an electrical connector 1 according to an embodiment of the present invention is shown to include a connector body 2 having a mating surface 201, which is adapted to mate with a mating component (not shown), and a mounting surface 203, which is adapted to face a printed circuit board (not shown). A plurality of passageways 20 extend from the mating surface 201 towards the mounting surfaces 203 and through the connector body 2. In this embodiment, terminals 3 are inserted in a direction from the mating surface 201 towards the mounting surface 203 through the connector body 2 to be held within the respective passageways 20.

Figure 2:
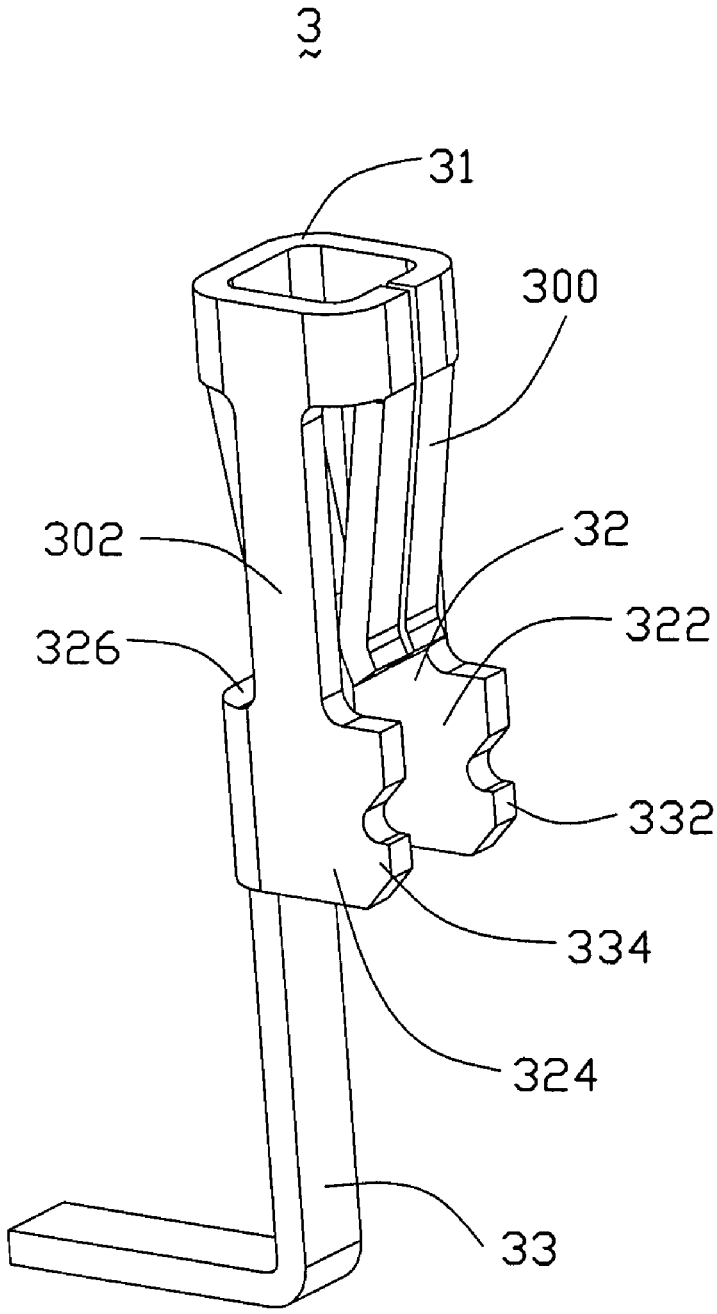
FIG. 2 is a perspective view of a terminal of the electrical connector of FIG. 1.

Referring particularly to FIG. 2, each of the terminals 3 includes a middle retention section 32, a front mating section 31 adapted to mate with a mating element from the component, and a rear mounting section 33 adapted to be surface mounted onto the printed circuit board. The front mating section 31 defines a receiving cavity being of a rectangular shape, which corresponds to that of the passageway 20. The receiving cavity of the front mating section 31 is formed by a peripheral wall with an axial gap therebetween. The gap of the front mating section 31 allows the terminal 3 for resiliently mating with the mating element from the component. The middle retention section 32, from a top view thereof, is of a U-shaped configuration, which is connected to the front mating section 31 by a pair of resilient slanted arms 300 and a pair of straight arms 302. The U-shaped middle retention section 32 is further composed of a first terminal retention wall 322, an opposite second terminal retention wall 324, and a third terminal retention wall 326 extending between the first and second terminal retention walls 322 and 324. Each of the terminal retention. walls 322, 324 or 326 defines thereof a bottom retention edge, which is adapted to be rested on passageway retention walls 202, 204 or 206 to securely hold the terminal 3 within the passageway 20 for preventing the connector body 2 from being removed by an upward force exerted thereon. Further, each of the first and second terminal retention walls 322 and 324 includes a deformable segment 332 or 334 extending from a side edge thereof for interferingly engaging the connector body 2, to be later described. The deformable segment 332 or 334 has a slot thereon, thereby having a deformable capability relative to remaining segments of the first or second terminal retention wall 322 or 324. The rear mounting section 33 is of, after being bent, an L-shaped configuration, which extends from the third terminal retention wall 326.

Figure 3:
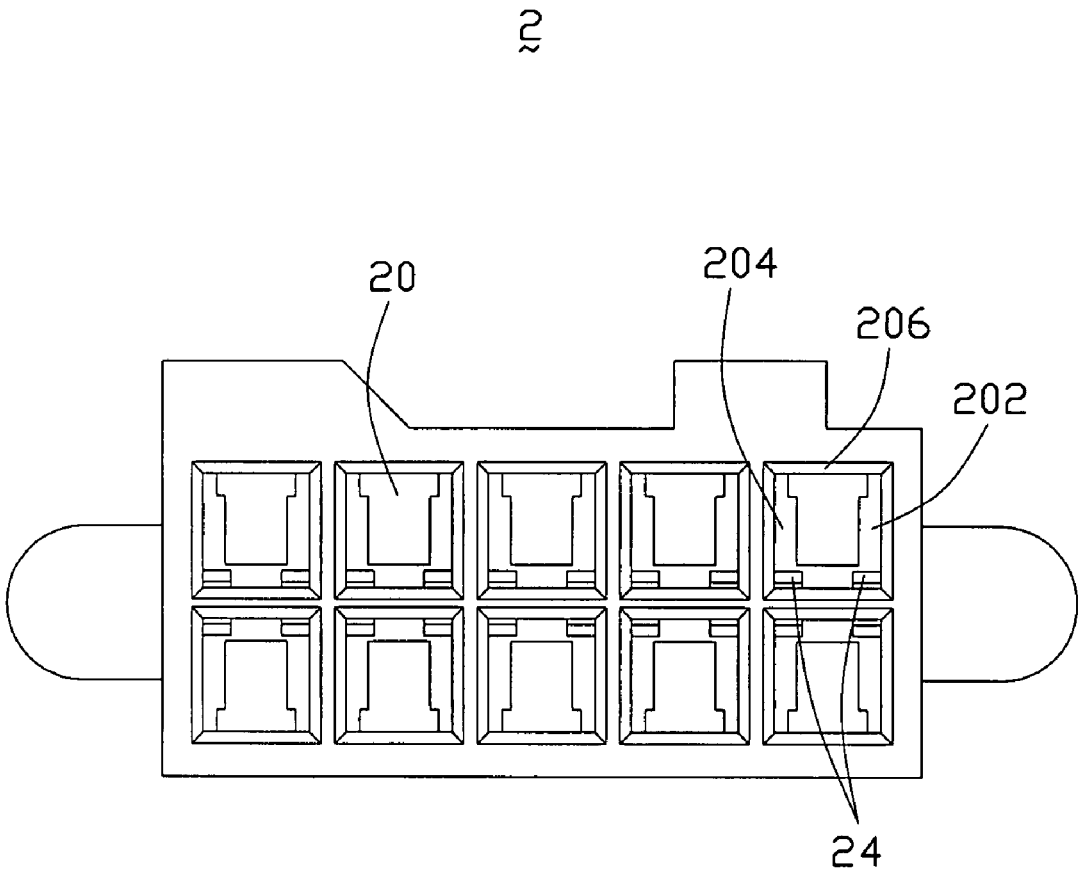
FIG. 3 is a top view of a connector body of the electrical connector of FIG. 1.
Figure 4:
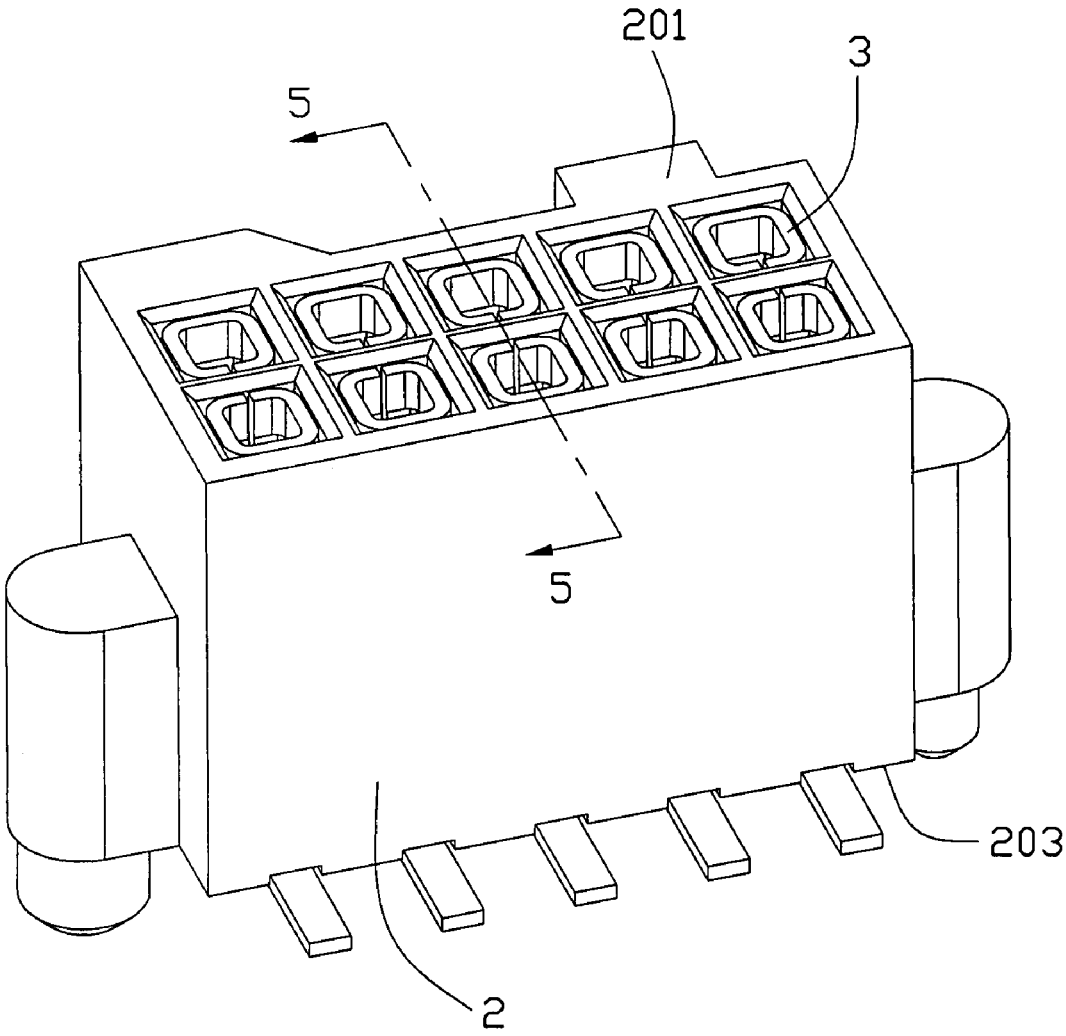
FIG. 4 is an assembled, perspective view of the electrical connector of FIG. 1, showing the terminals fully inserted into the connector body.
Figure 5:
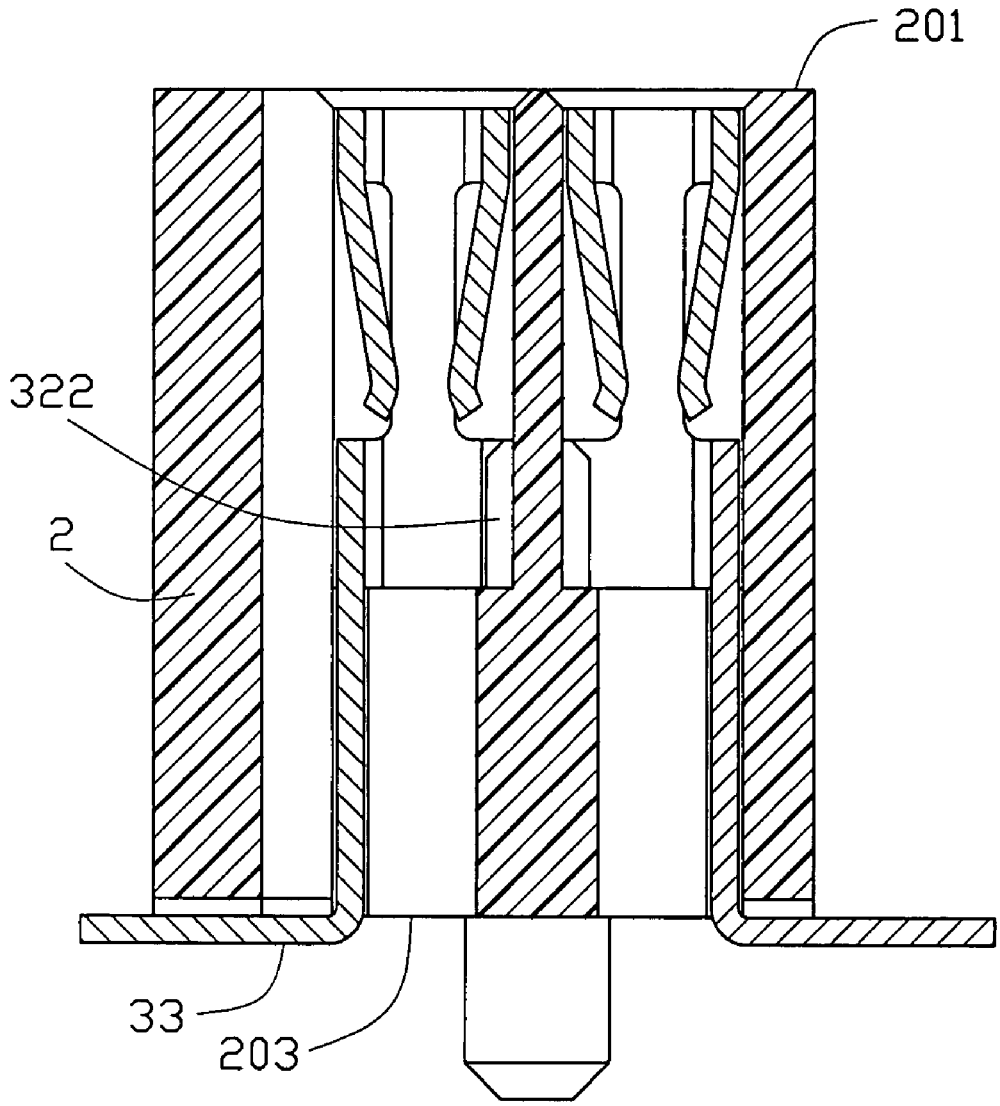
FIG. 5 is a cross sectional view of the electrical connector of FIG. 4 taken along line 5-5 thereof.
Figure 6:
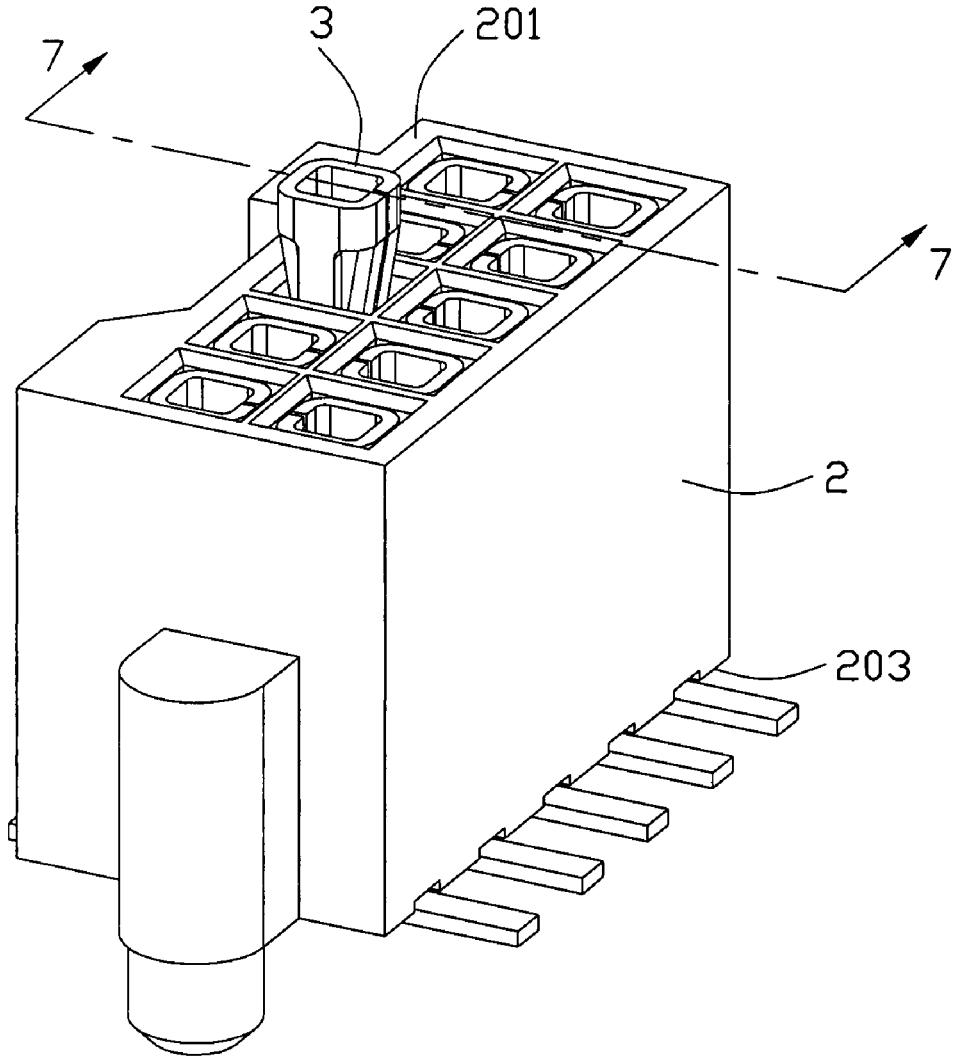
FIG. 6 is an assembled, perspective view of the electrical connector of FIG. 1, but showing one terminal not fully inserted into the connector body.
Figure 7:
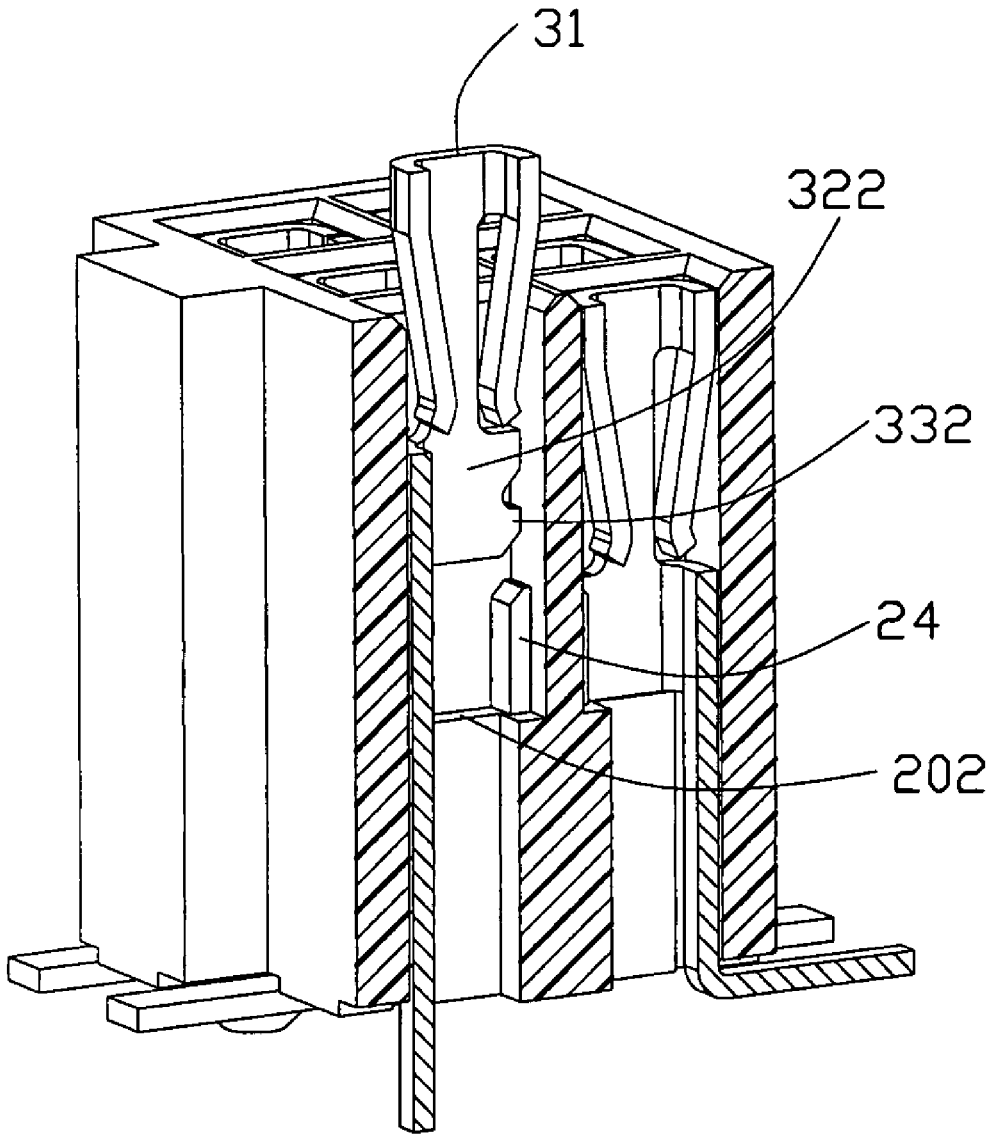
FIG. 7 is a cross sectional view of the electrical connector of FIG. 6 taken along line 7-7 thereof.

Referring particularly to FIGS. 3 and 7, each of the passageways 20, being of a rectangular shape, further includes three passageway retention walls 202, 204, 206 extending a distance away from the mounting surface 203 of the connector body 2 and into the passageway 20. The three passageway retention walls 202, 204 and 206 are disposed along corresponding edges of the rectangular passageway 20 (see FIG. 7). The passageway 20 further includes two extension tabs 24 located at two corners of the passageway 20 respectively and extending a distance from the corresponding passageway retention walls 202 and 204 for corresponding to the two deformable segments 332 and 334 of the terminal 3. In FIG. 7, during the insertion of the terminal 3 into the passageway 20, the deformable segments 332 and 334 of the terminal 3 interferingly engage the two extension tabs 24 of the passageway 20, before the bottom retention edges of the three terminal retention walls 322, 324 and 326 are to be rested on the corresponding passageway retention walls 202, 204 and 206 of the passageway 20. As compared with the prior art, this arrangement will prevent the connector body 2 to be removed from the printed circuit board by an improperly upward force exerted thereon, such as force applied to pull out the mating component from the electrical connector 1.

Referring particularly to FIGS. 1 and 7, in assembly, each of the terminals 3 is downwardly inserted into the respective passageways 20 of the connector body 2, i.e., in a direction from the mating surface 201 towards the mounting surface 203, by not bending the rear mounting section 33 of the terminal 3. During the insertion of the terminal 3 into the passageway 20, the deformable segments. 332 and 334 of the terminals 3 interferingly engage the extension tabs 24 of the passageway 20, until the terminal retention walls 322, 324 and 326 are to be rested on the passageway retention walls 202, 204 and 206, respectively. This will prevent the connector body 2 to be removed by the upward force, i.e., in a direction from the mounting surface 203 towards the mating surface 201. After the terminal 3 is fully inserted into the passageway 20, the rear mounting section 33 is bent to be the L-shaped configuration, which is adapted to be surface mounted onto the printed circuit board.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

a connector body having a mating surface and a mounting surface, and a plurality of passageways extending from the mating surface towards the mounting surface and through said connector body;

a passageway retention wall extending into each of the passageways; and terminals inserted into the passageways from the mating surface, each of said terminals including a mating section essentially having opposite front and back walls and two opposite side walls commonly defining a frame like cross-section with a receiving cavity therein, the front wall including a pair of cantilevered spring arms with a gap therebetween while the back wall having a solder tail extending therefrom for mounting to a printed circuit board on which the connector is seated, at least one of said side walls having a rigid retention plate defining thereof a retention edge, said retention edge adapted to be rested on said passageway retention wall for securing said terminal onto the connector body.

2. The electrical connector of claim 1, wherein said terminal retention section is formed by three terminal retention walls each defining thereof a retention edge, three passageway retention walls extending into the passageway for being in correspondence with said three terminal retention walls, said retention edges of the three terminal retention walls adapted to be rested on the three passageway retention walls.

3. The electrical connector of claim 1, wherein said terminal retention section includes a deformable segment extending from a side edge thereof for interferingly engaging the passageway.

4. The electrical connector of claim 3, wherein said deformable segment defines a slot thereon.

5. The electrical connector of claim 3, further comprising an extension tab extending from said passageway retention wall, said deformable segment adapted to interferingly engage said extension tab of the passageway.

6. The electrical connector of claim 1, wherein said terminal retention section includes two deformable segments extending from opposite side edges thereof for interferingly engaging the passageway.

7. The electrical connector of claim 6, wherein each of said deformable segments defines a slot thereon.

8. An electrical connector comprising:

a connector body having a mating surface and a mounting surface, and a plurality of passageways extending from the mating surface towards the mounting surface and through said connector body;

at least some of the passageways each including a passageway retention wall extending thereinto; and terminals inserted into the passageways, said terminals, associated with said at least some of the passageways, each including a mating section essentially having opposite front and back walls and two opposite side walls commonly defining a frame like cross-section with a receiving cavity therein, the front wall including a pair of cantilevered spring arms with a gap therebetween while the back wall having a solder tail extending therefrom for mounting to printed circuit board on which the connector is seated, at least one of said side walls having a rigid retention plate defining thereof a retention edge, said retention edge adapted to be rested on said passageway retention wall for securing said terminal onto the connector body.

9. A vertical type electrical connector comprising:

an insulative housing defining opposite upper and bottom faces with a plurality of passageways extending therebetween and further therethrough in a vertical direction, each of said passageways defining an upward retention face;

a plurality of contacts, from the upper face, inserted into and disposed in the corresponding passageways respectively, each of said contacts defining a retention wall, and a solder tail for mounting to a printed circuit board on which the connector is seated; and said retention wall downwardly abutting against the corresponding retention face so as to prevent further upward movement of the housing relative to the contact.

10. The vertical electrical connector as claimed in claim 9, wherein the contact defines a square like front mating section with a slit therein intimately facing a corresponding wall face of the corresponding passageway, and a pair of contacting arms downwardly extend from square like front mating section by two sides of said slit and commonly intimately face said corresponding wall face.

11. The vertical type electrical connector as claimed in claim 9; wherein said solder tail extends horizontally and outward under a side wall of the housing so as to prevent a further downward movement of the housing relative to the contact.

12. The vertical type electrical connector as claimed in claim 11, wherein said solder tail is originally coplanar with the side wall during insertion of the contact into the passageway while horizontally and outwardly bent after the retention wall is seated upon the retention face.

13. The vertical type electrical connector as claimed in claim 11, wherein said retention face is located on an inner side of the passageway while the side wall of the housing is located on an outer side of the passageway.

14. The vertical type electrical connector as claimed in claim 13, wherein said contact includes a pair of resilient arms respectively located on the inner side and the outer side of the passageway.

15. The vertical type electrical connector as claimed in claim 13, wherein the retention wall includes at least one barb on a side edge thereof.

16. The vertical type electrical connector as claimed in claim 13, wherein the retention wall extends between the inner side and the outer side, and only engages the retention face on the inner side.

* * * * *